US006066038A

United States Patent [19]

Sciortino et al.

[11] Patent Number: 6,066,038

[45] Date of Patent: May 23, 2000

[54] AUTOMATIC HOPPER FILL SYSTEM FOR COIN DISPENSING MACHINES

[75] Inventors: Michael J. Sciortino; John A. Forte, both of Arlington Heights; James J Grinsteiner, Union, all of Ill.; Allan M. Brown, St. Hubert, Canada

[73] Assignee: Glenview Systems, Inc., Glenview, Ill.

[21] Appl. No.: 09/204,332

[22] Filed: Dec. 2, 1998

[51] Int. Cl.[7] ..... G07D 9/00

[52] U.S. Cl. ..... 453/17; 222/56

[58] Field of Search ..... 453/17; 222/56

[56] References Cited

U.S. PATENT DOCUMENTS

| | | | |
|---|---|---|---|
| 3,680,566 | 8/1972 | Tanaka et al. | 453/17 |
| 3,971,393 | 7/1976 | Akai et al. . | |
| 4,342,384 | 8/1982 | Fukase et al. . | |
| 5,366,407 | 11/1994 | Sentoku . | |
| 5,386,903 | 2/1995 | Rothschild et al. . | |
| 5,467,857 | 11/1995 | Takemoto | 194/206 |
| 5,531,640 | 7/1996 | Inoue | 453/17 |
| 5,688,165 | 11/1997 | Levasseur | 453/9 |

*Primary Examiner*—Robert P. Olszewski
*Assistant Examiner*—Bryan Jaketic
*Attorney, Agent, or Firm*—Silverman, Cass & Singer, Ltd.

[57] ABSTRACT

An automatic hopper fill system for a coin dispensing machine. An auxiliary coin reservoir container is positioned entirely within the machine to perform the hopper fill function when the hopper becomes empty. The container includes an opening or chute which is normally blocked by an electro-mechanically controlled release door and opened electronically by a circuit which reads a hopper empty code generated to release the auxiliary coin reserve into the hopper. An indicator light is mounted on the external surface of the machine to indicate that the auxiliary container has released the coin reserve into the hopper so that the auxiliary container can be re-filled with coins at a convenient time.

10 Claims, 21 Drawing Sheets

FIG. 15

| ITEM | QUANTITY | REFERENCE | PART | DESCRIPTION | MFG | PART NUMBER |
|---|---|---|---|---|---|---|
| 1 | 2 | R11, R10 | 100r | RESISTOR | DALE | CRCW0805101J |
| 2 | 3 | R2, R3, R4 | 10k0 | RESISTOR | DALE | CRCW0805103J |
| 3 | 1 | R3 | 22k0 | RESISTOR | DALE | CRCW0805223J |
| 4 | 1 | DC1 | 0u1F | CAPACITOR | AVX | 08051C104MAT |
| 5 | 2 | C1, C2 | 47u0F Ta | TANTALUM CAP | SPRAGUE | CWR11DH476M |
| 6 | 1 | JP2 | JACKS DC | JACK DC | MODE | 31-155-0 |
| 7 | 1 | JP3 | MOLEX 3 | PIN HEADER | MOLEX | 42225-22-28-3030 |
| 8 | 1 | JP4 | MOLEX 6 | PIN HEADER | MOLEX | 42225-22-28-3060 |
| 9 | 1 | JP1 | MOLEX 10 | PIN HEADER | MOLEX | 42225-22-28-3100 |
| 10 | 1 | D2 | LED-R-SM | SM RED LED | LITE-ON | LTL-94PCK-TA |
| 11 | 1 | D3 | LED -G-SM | SM GRN LED | LITE-ON | LTL-94PGK-TA |
| 12 | 1 | D1 | LL4148 | SM REV VOLT DIODE | MOTO | LL4148-GS08 |
| 13 | 1 | U2 | LM2931S-5.0 | SM 5V VOLTAGE REG | NATIONA | L LM2931S-5.0 |
| 14 | 1 | U3 | TD62003F | SM PER. DRV. ARRAY | S TOSHIBA | TD62003F |
| 15 | 1 | U1 | PIC12C508(SOIC) | SM 8 PIN CPU | MICROCH | PIC12C508/L |
| 16 | 1 | SW1 | MINI SPST | MINI SWITCH | OMRON | B3F-1000 |

AUTOMATIC HOPPER FILL SYSTEM FOR COIN DISPENSING MACHINES

BACKGROUND OF THE INVENTION

1. Field of the Invention

This invention relates generally to coin dispensing machines, and more particularly, to apparatus for automatically supplying coins to the coin-retaining hopper of such machines.

2. Description of the Prior Art

In operation of Prior Art coin dispensing machines, such as slot machines and many other types of amusement and gaming devices, coins or tokens are automatically paid out to a player as prizes or awards. These coins normally are disbursed from a hopper which retains a percentage of coins played for this purpose. The increasing use of paper currency acceptors in such machines, however, often creates a "deficit" situation in which the number of coins in the hopper required for a payout is less than the amount to be paid.

Certain prior art structures employed to resolve this problem require a manual refilling procedure of the hopper with coins brought from a cashier station by a "hopper fill" team consisting of several supervisory and management personnel to monitor the cash handling. During the hopper refilling procedure, which can involve an extended period of time, the machine is out of service to the players.

Other prior art structures incorporate supplemental coin hopper fill devices, but such structures generally are located external of the slot machine and thereby give rise to undesirable security and other operational concerns.

SUMMARY OF THE INVENTION

The invention is characterized by an auxiliary reservoir container of coins or tokens which is positioned entirely within a coin dispensing machine, such as a slot machine, which will perform a hopper fill function automatically or semi-automatically when required. A supply of coins (usually about 1,000) is stored in the coin reservoir container which is connected to a discharge opening or chute positioned over the conventional coin payout hopper. The opening or end of the chute is blocked by an electro-mechanically controlled release door which is opened either manually by a key switch externally mounted on the machine and activated by a single authorized person, or automatically by an electronic circuit which reads a low coin status code generated in the slot machine hopper. An indicator light visible externally of the slot machine indicates that the device has been triggered. The reservoir of the triggered machine can then be refilled at a time during which the machine is inactive, thereby eliminating the downtime associated with prior art machines.

Various objects and advantages of the invention will become apparent in accordance with the ensuing disclosure in which the preferred embodiments are described in detail in the specification and illustrated in the accompanying drawings. It is contemplated that minor variations may occur to the skilled artisan without departing from the scope or sacrificing any of the advantages of the invention.

BRIEF DESCRIPTION OF THE DRAWINGS

FIG. 15 is a list of the parts embodied in the circuit shown in FIG. 14;

DESCRIPTION OF THE PREFERRED EMBODIMENTS

Figure 1:
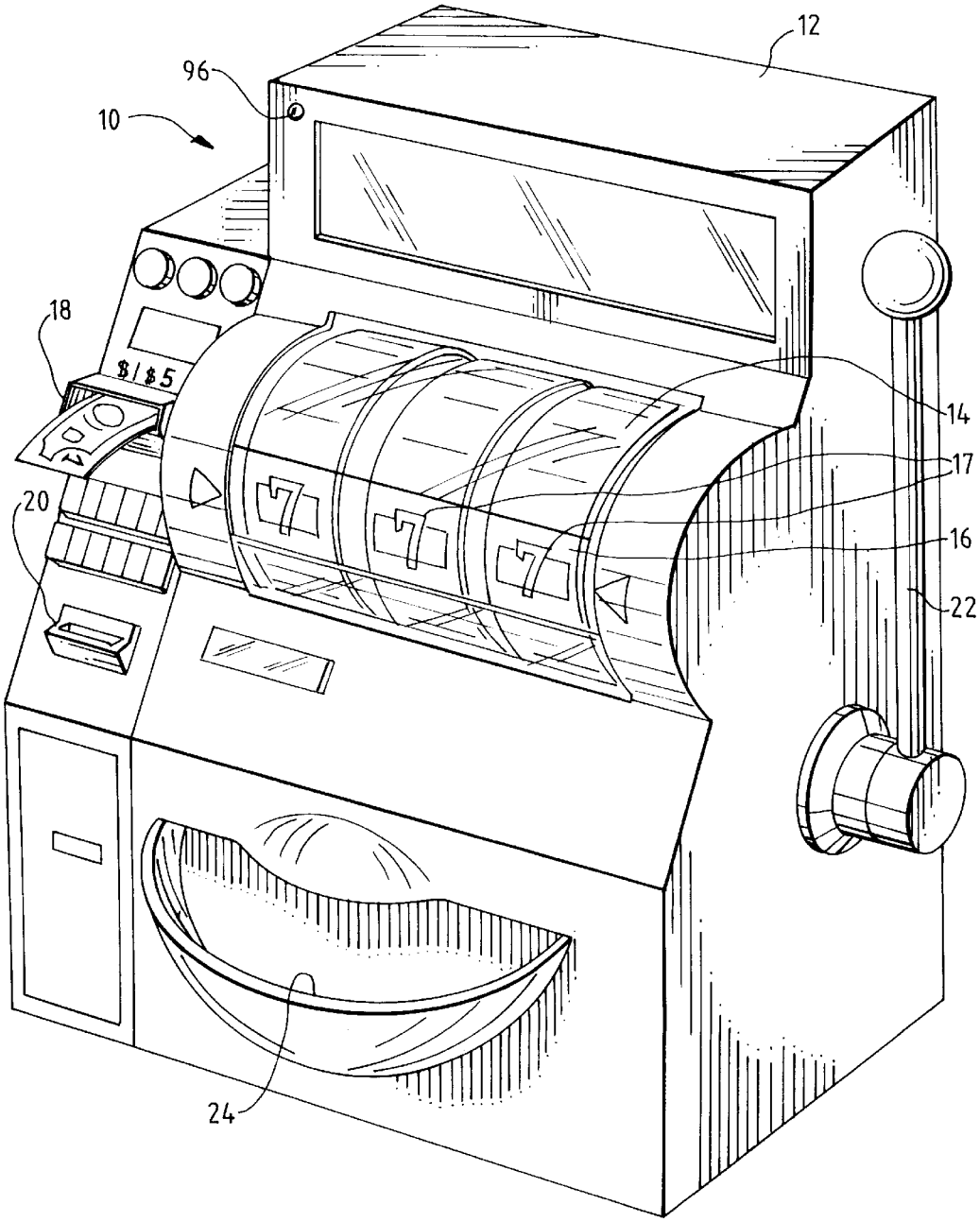
FIG. 1 is a perspective view of a coin dispensing slot machine of the type in which the auxiliary coin reservoir of the invention is employed.

Referring to FIG. 1, a coin dispensing machine is shown in the form of a slot machine 10. Slot machine 10 includes a cabinet 12 having window 14 through which are visible game reels 16 mounted within the cabinet 12. A user of the slot machine inserts currency into slot 18, or coins into slot 20, to enable the machine to be activated in known manner, such as by pulling on lever 22, to cause the reels 16 to rotate. Currency which is inserted into slot 18 is accumulated in a reservoir to be removed when desired by the machine owner. Coins which are inserted into slot 20 are directed along a conduit (not shown) to a coin hopper within the machine where they are accumulated for removal by the machine owner and/or dispensed to a machine user, also in known manner. After the machine 10 is activated by pulling on lever 22, if display pictures 17 arranged on reels 16 line up in a manner predefined by the rules of the slot machine, the machine releases a quantity of coins from the coin hopper within the cabinet 12 to the dispensing tray 24 positioned on the external side of the cabinet for removal by the user of the machine.

Referring to FIGS. 2–8, certain internal operational elements of the slot machine 10 are shown together with the elements of the invention. It is to be understood that the invention is adapted for installation within any conventional coin dispensing machine, of which slot machine 10 is only one example. Also, the elements of a conventional slot machine which are shown in the drawings are only those which are necessary to an understanding of the present invention, and many conventional elements which are not necessary to an understanding of the invention are not illustrated.

Game reels 16 are mounted within slot machine 10 upon reel shelf or platform 26, which also serves as a mount for lever 22. Coin hopper 28 is positioned within cabinet 12 below reel shelf 26 with a bottom part 30 located adjacent to dispensing tray 24. Coins 32 are accumulated within hopper 28 as they are inserted into slot 20 and move along a conduit (not shown) to deposit such coins into the hopper. The coins 32 are dispensed from the bottom part 30 within cabinet 12 into the tray 24 which extends outside of cabinet 12 in a known manner in accordance with the operation of conventional slot machines.

In operation of conventional slot machine 10, if coin hopper 28 becomes empty because the coins 32 retained therein are completely dispensed into tray 24, the slot machine becomes deactivated and is not available for further use until the hopper 28 is re-filled with additional coins. The invention provides means to effect such re-filling either automatically or semi-automatically without the need to deactivate the machine.

The invention includes an auxiliary coin reservoir container 34 mounted within cabinet 12 on the underside 36 of reel shelf 26. Container 34 includes a top opening 38, best seen in FIG. 3, having a pair of oppositely-disposed rails 40, 42 which slide in tracks 44, 46 mounted to the underside 36 of shelf 26. Container 34 thereby is slidable between a first operating position in which opening 38 is completely below and closed by shelf 26 (FIG. 2), and a second filling position (FIG. 3) in which opening 38 is exposed upon withdrawing the container 34 from its first position.

A trap door 48 is pivotally installed at the bottom 50 of container 34 and is movable about pivot bar 52 between a first closed portion 54 and a second open position 56 in which mouth 58 of container 34 opens above hopper 28. Pivot bar 52 is retained between brackets 60, 62 mounted to side walls 64, 66 of container 34. A follower 68 is secured to one end 70 of bar 52 and engages an activation pin 72 operated by solenoid 74 mounted to side wall 64 of container 34. Solenoid 74 is operated by trigger circuit 76 (FIG. 14) to cause trap door 48 to open in the manner to be described.

Figure 2:
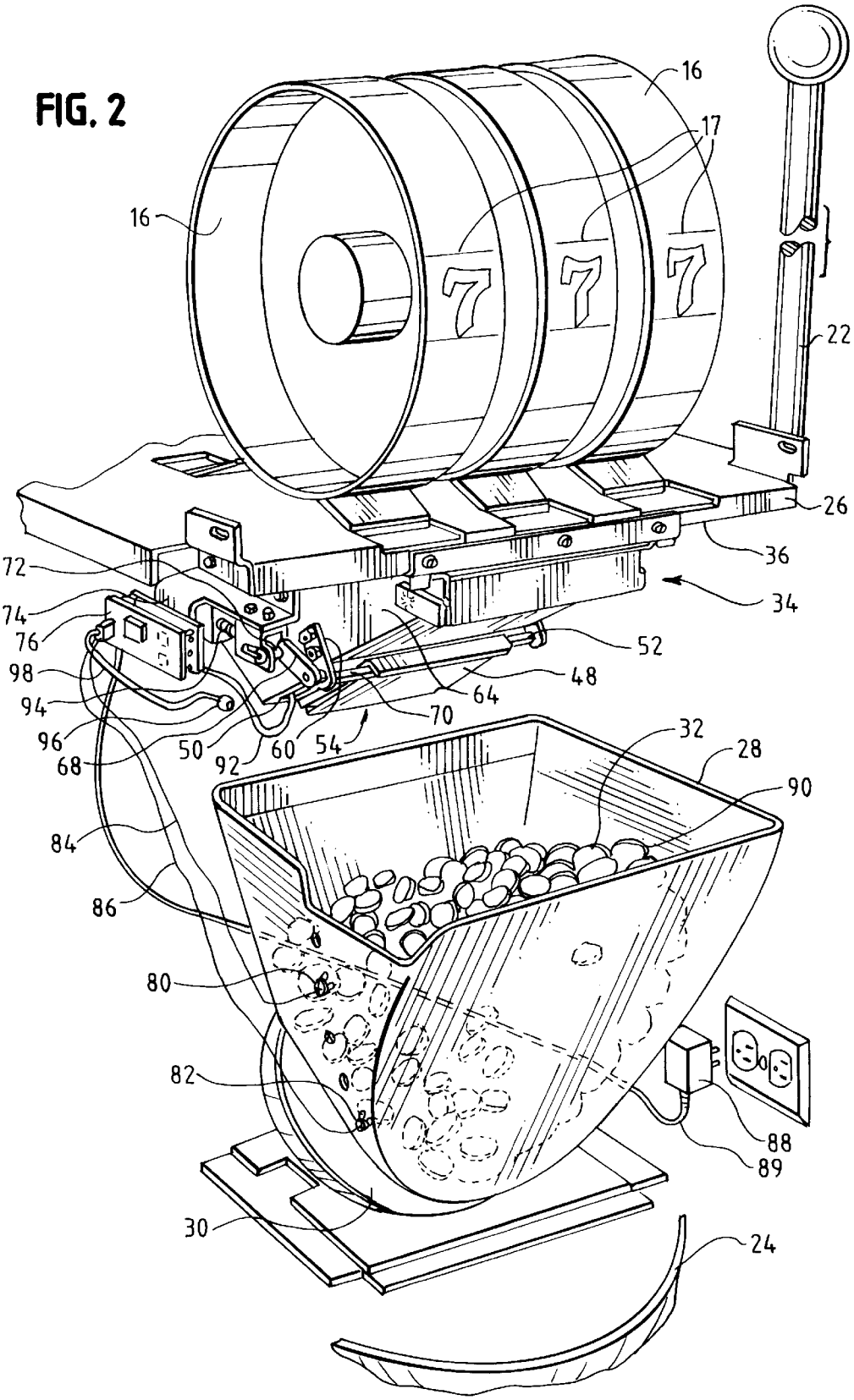
FIG. 2 is a perspective view of certain of the inner components of the slot machine of FIG. 1, shown with the coin reservoir of the invention installed together therewith.
Figure 3:
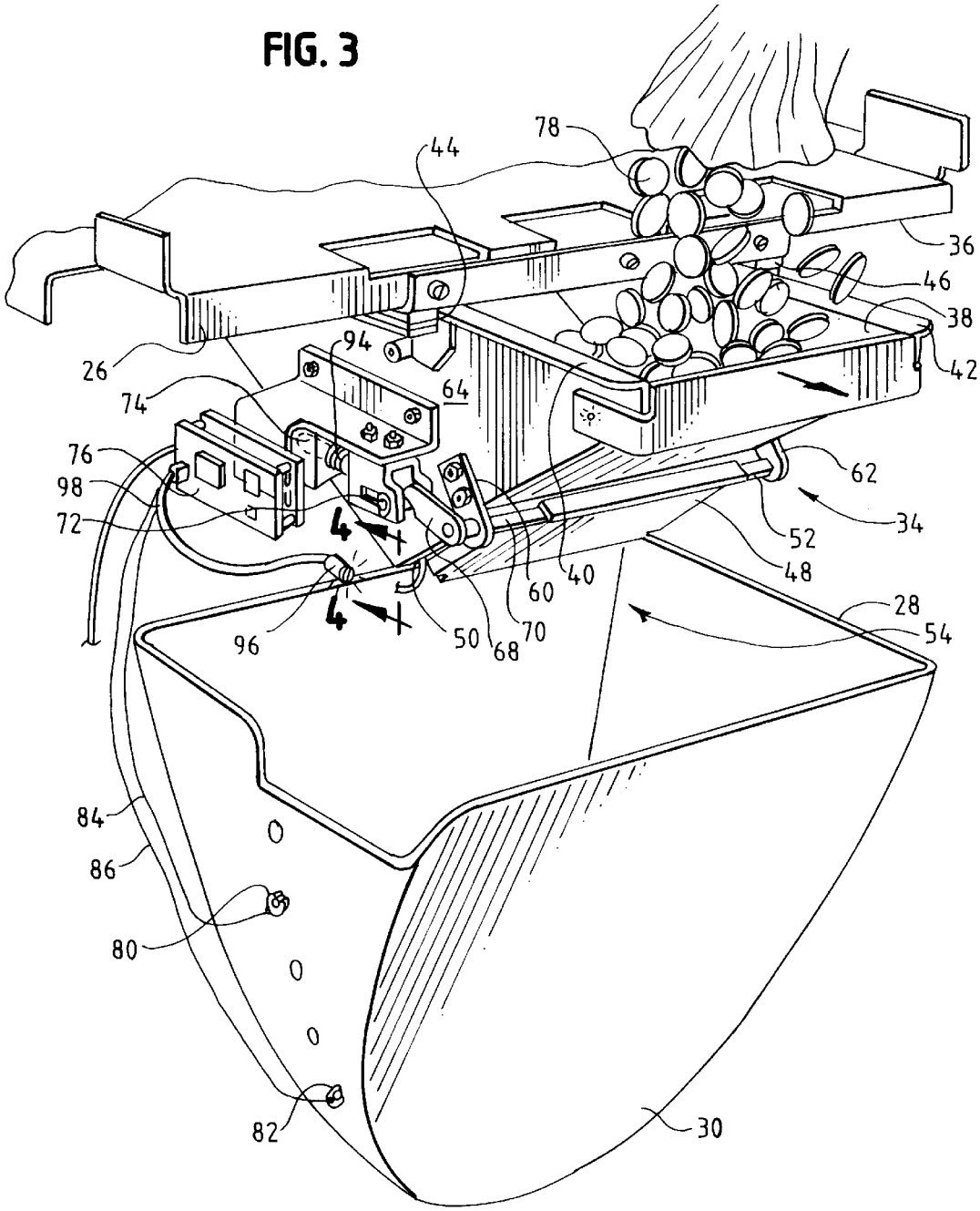
FIG. 3 is an enlarged perspective view similar to that of FIG. 2, showing the manner in which the coin reservoir of the invention initially is filled with coins.
Figure 4:
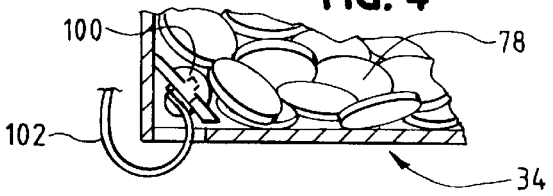
FIG. 4 is a sectional view taken along the line 4—4 of FIG. 3, in the direction indicated generally.
Figure 5:
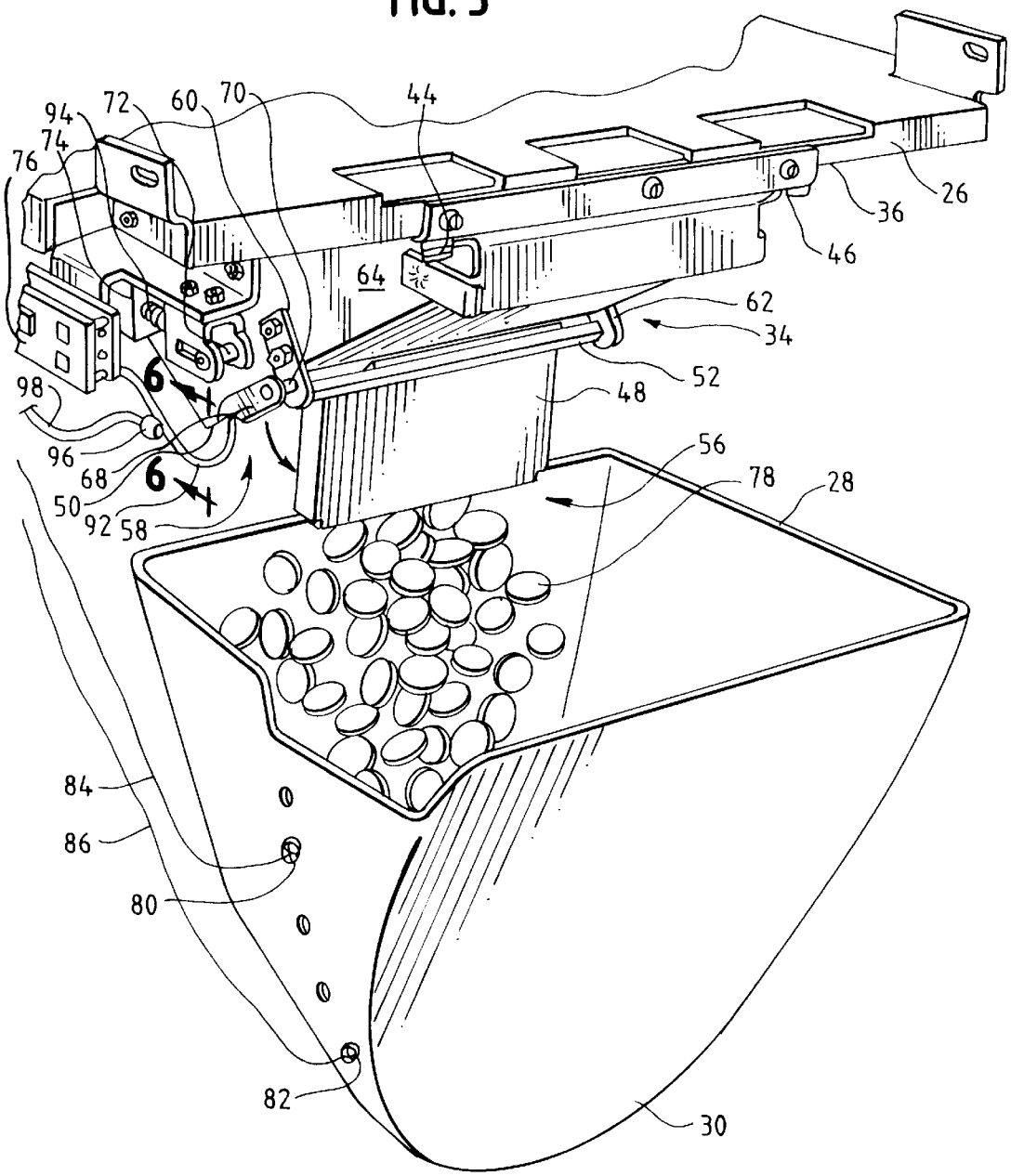
FIG. 5 is a perspective view similar to that of FIG. 3, showing the manner in which the coin reservoir of the invention empties coins retained therein into the slot machine coin hopper.
Figure 6:
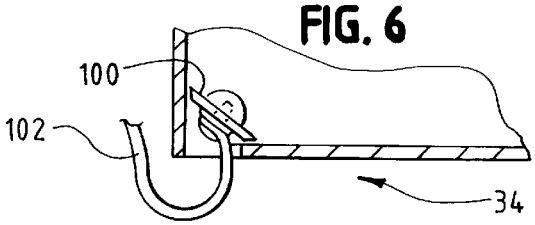
FIG. 6 is a sectional view taken along the line 6—6 of FIG. 5, in the direction indicated generally.
Figure 7:
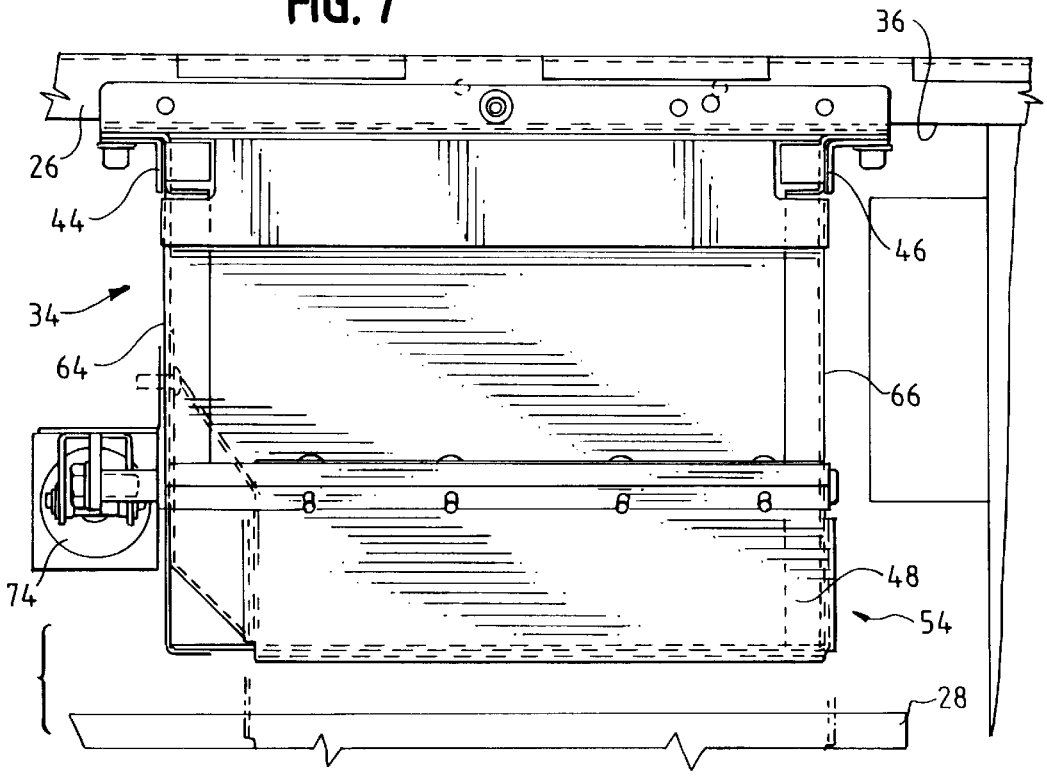
FIG. 7 is a front elevational view of the coin reservoir of the invention.
Figure 8:
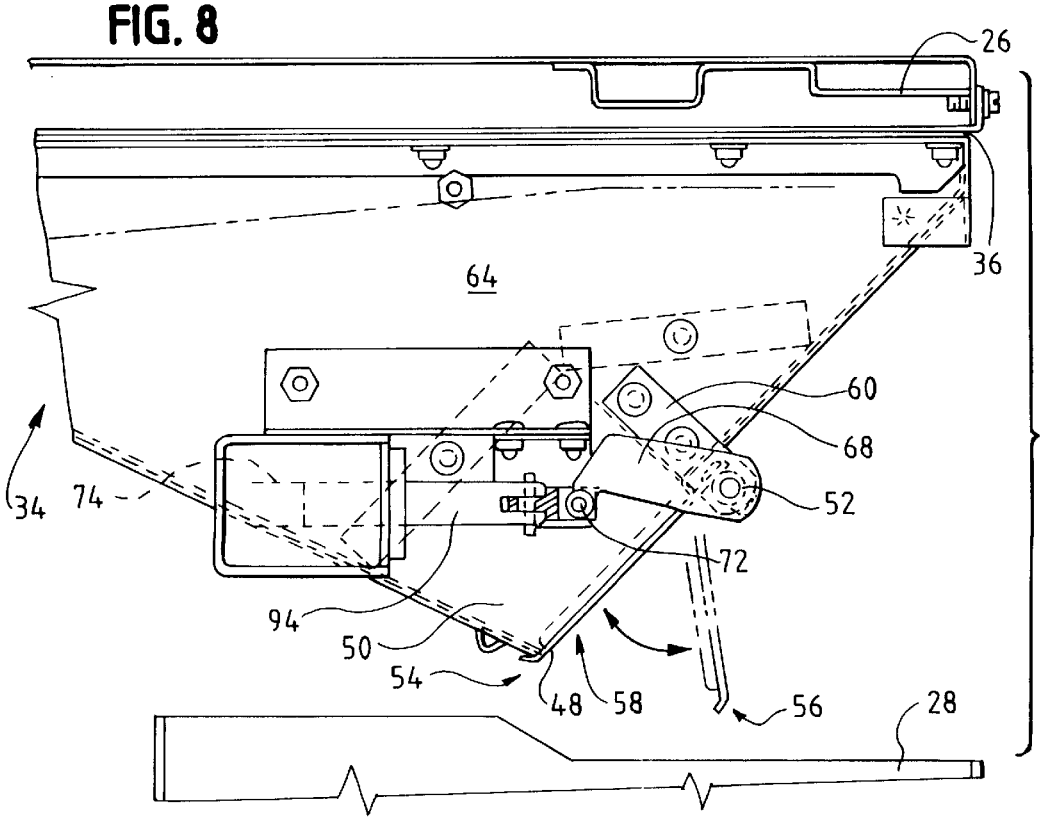
FIG. 8 is a side elevational view of the coin reservoir of the invention.

Container 34 initially is filled with coins 78 when trap door 48 is in its closed position 54 by sliding container 34 to its second filling position seen in FIG. 3. After being so filled, container 34 is moved to its first operating position by sliding rails 40, 42 along tracks 44, 46 so that opening 38 is completely below and closed by shelf 26, as seen in FIG. 2. In its thus coin filled condition, the auxiliary reservoir container and automatic hopper fill system of the invention is ready for operation.

Referring to FIGS. 11–15, the sequence of operation and electrical trigger circuit 76 for enabling same are illustrated. Coins 32 fill hopper 28 to approximately its complete capacity as seen in FIG. 2. The coins in the thus filled condition of hopper 28 establish an electrical connection between separated contacts 80,82 installed within the hopper. An electrical plug 81 joins electrical leads 84,86 between contacts 80,82 along lead 83 to the trigger circuit 76 (FIG. 14) comprised of parts described in FIG. 15. The trigger circuit is energized by power supplied through plug 88 along lead 89 in conventional manner.

As the slot machine continues to dispense coins 32 from hopper 28 during play of the machine by a user, the level 90 of such coins (FIG. 2) will fall below that of contact 80, thus breaking the electrical connection between contacts 80,82. The trigger circuit 76 thereby causes solenoid 74 to be energized by a signal transmitted through lead 92. Plunger 94 thereby is drawn into the solenoid to move pin 72, thus disengaging follower 68 and permitting trap door 48 to move to open position 56 (see FIG. 5), thereby releasing coins 78 from container 34 into hopper 28 to effect re-filling same. In this manner, operation of the slot machine 10 can continue without being shut down due to an empty condition of hopper 28. Auxiliary reservoir container 34 can be re-filled by the machine owner at a convenient time when the machine is not in use.

Figure 12:
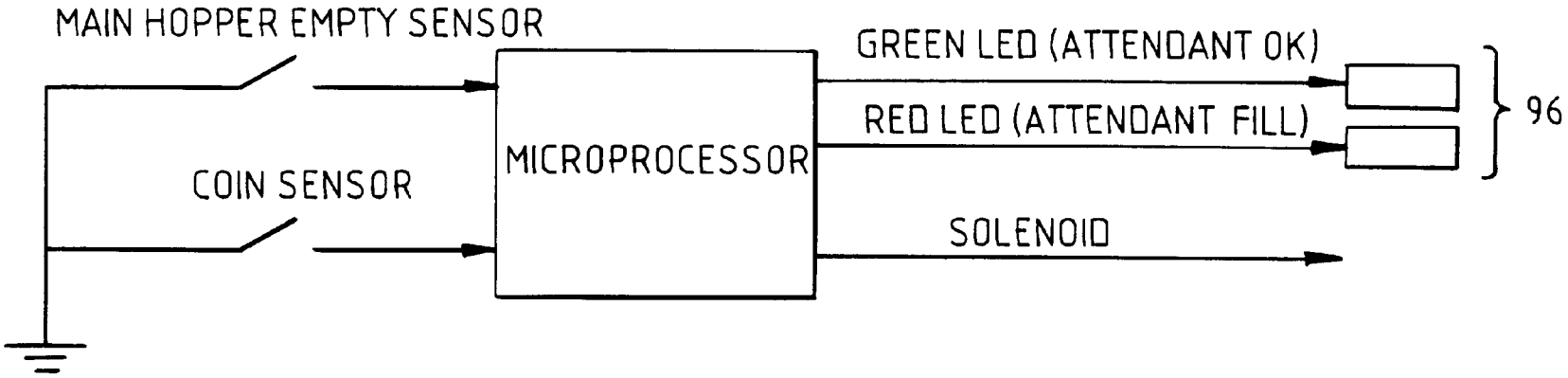
FIG. 12 is a block diagram showing operational features of the coin reservoir of the invention.
Figure 13:
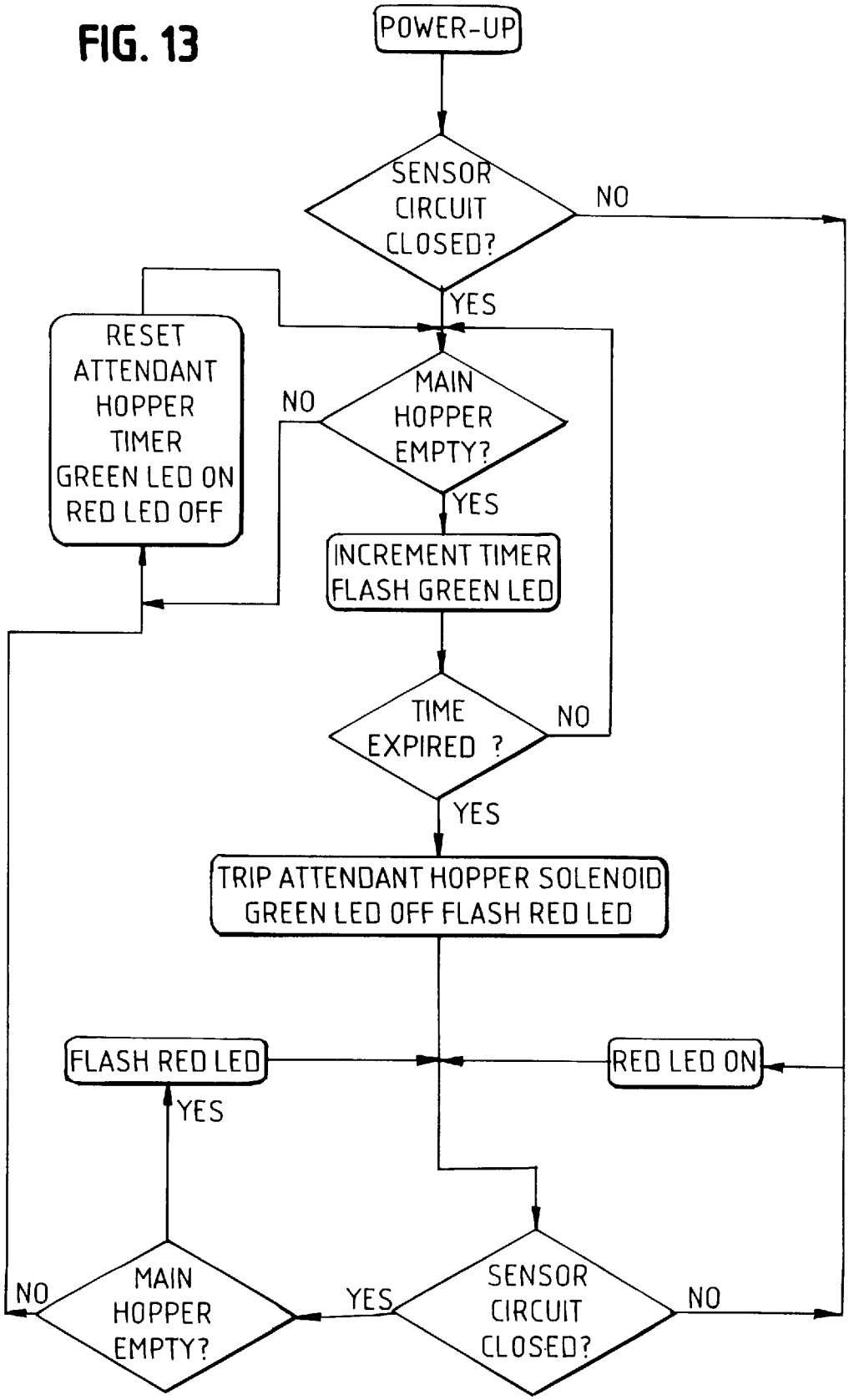
FIG. 13 is a flowchart for operation of the coin reservoir of the invention.

Signal light 96 is provided to alert the machine owner to the fact that the auxiliary reservoir container 34 has been activated to deposit coins 78 into hopper 28 and therefore should be refilled at a convenient time. Signal light 96 is positioned at a convenient location on the external surface of cabinet 12, and is connected by leads 98 to trigger circuit 76 shown in FIG. 14. As indicated in FIGS. 12 and 13, signal light 96 is a two-color red/green LED lamp. In the initial condition when both hopper 28 and container 34 are filled with coins, coins 32 establish electrical connection between contacts 80,82, and coins 78 engage contactor 100 positioned at the bottom of container 34 (FIGS. 3–4) to send a signal to the trigger circuit along electrical lead 102 to cause the trigger circuit to energize a steady green condition of signal light 96. When the level of coins 32 falls below that of contact 80 in hopper 28, the trigger circuit causes the signal light to show a flashing green condition, and a short time thereafter, the trigger circuit energizes solenoid 74 to release trap door 48 and automatically cause coins 78 to be deposited from container 34 to hopper 28. [Alternatively, the trigger circuit could be adjusted so as not to energize the solenoid 74 to release trap door 48 until the machine owner activates a key switch (not shown) externally mounted on cabinet 12 so as to semi-automatically operate the hopper fill operation.] Thereafter, the trigger circuit causes the signal light to show a steady red color. This condition continues until the container 34 is refilled with coins. To do so, the machine owner pushes trap door 48 to its closed position 54 so that follower 68 engages activation pin 72, pulls container 34 to its second filling position (FIG. 3), and fills the container with coins which engage contactor 100 and send a signal to trigger circuit 76, which thereupon causes the signal light to again show a steady green color. Container 34 then is pushed to its first operating position shown in FIG. 2 to complete the re-filling operation.

Alternatively signal light 96 may be eliminated and trigger circuit 76 adjusted to send an electrical signal to a computer or other signal receptor (not shown) to indicate that the container 34 has been activated to deposit coins 78 into hopper 28.

Figure 9:
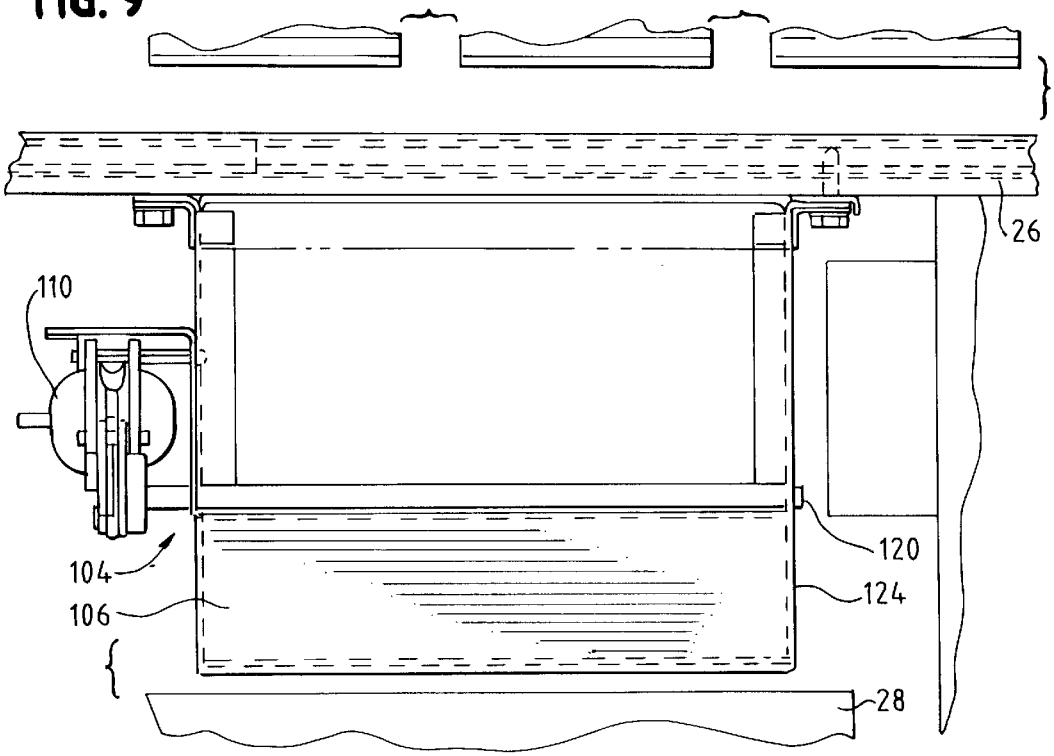
FIG. 9 is a front elevational view of an alternate embodiment of the coin reservoir of the invention.
Figure 10:
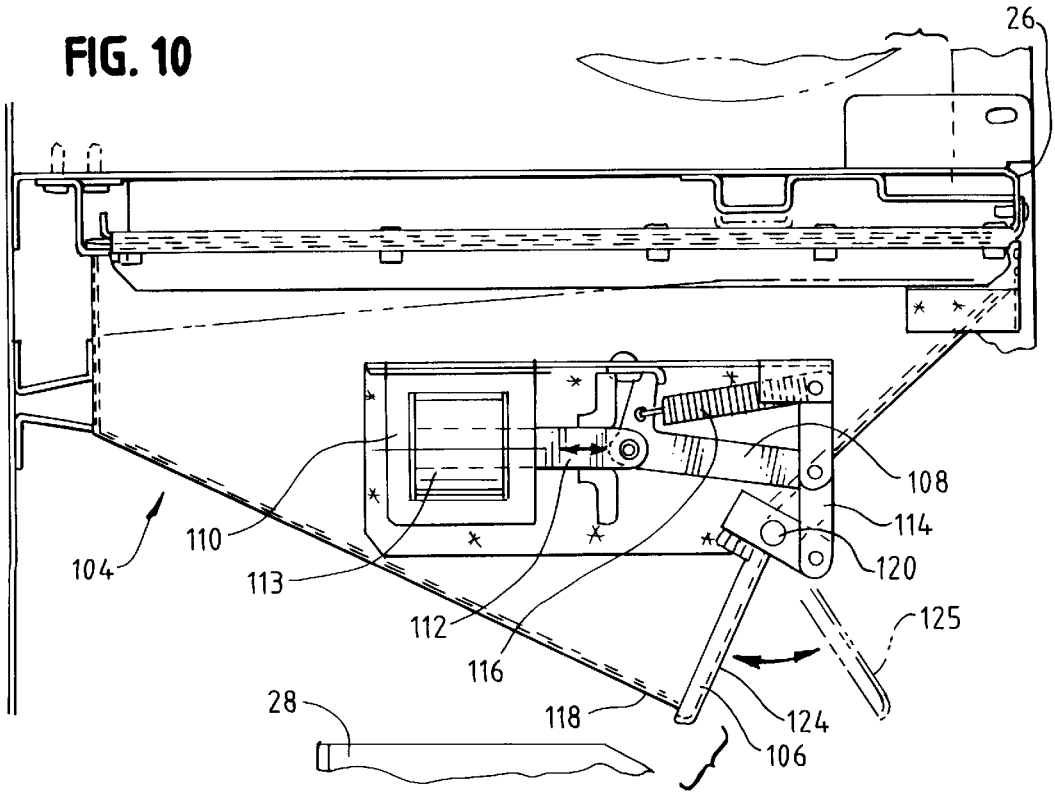
FIG. 10 is a side elevational view of the coin reservoir shown in FIG. 9.
Figure 11:
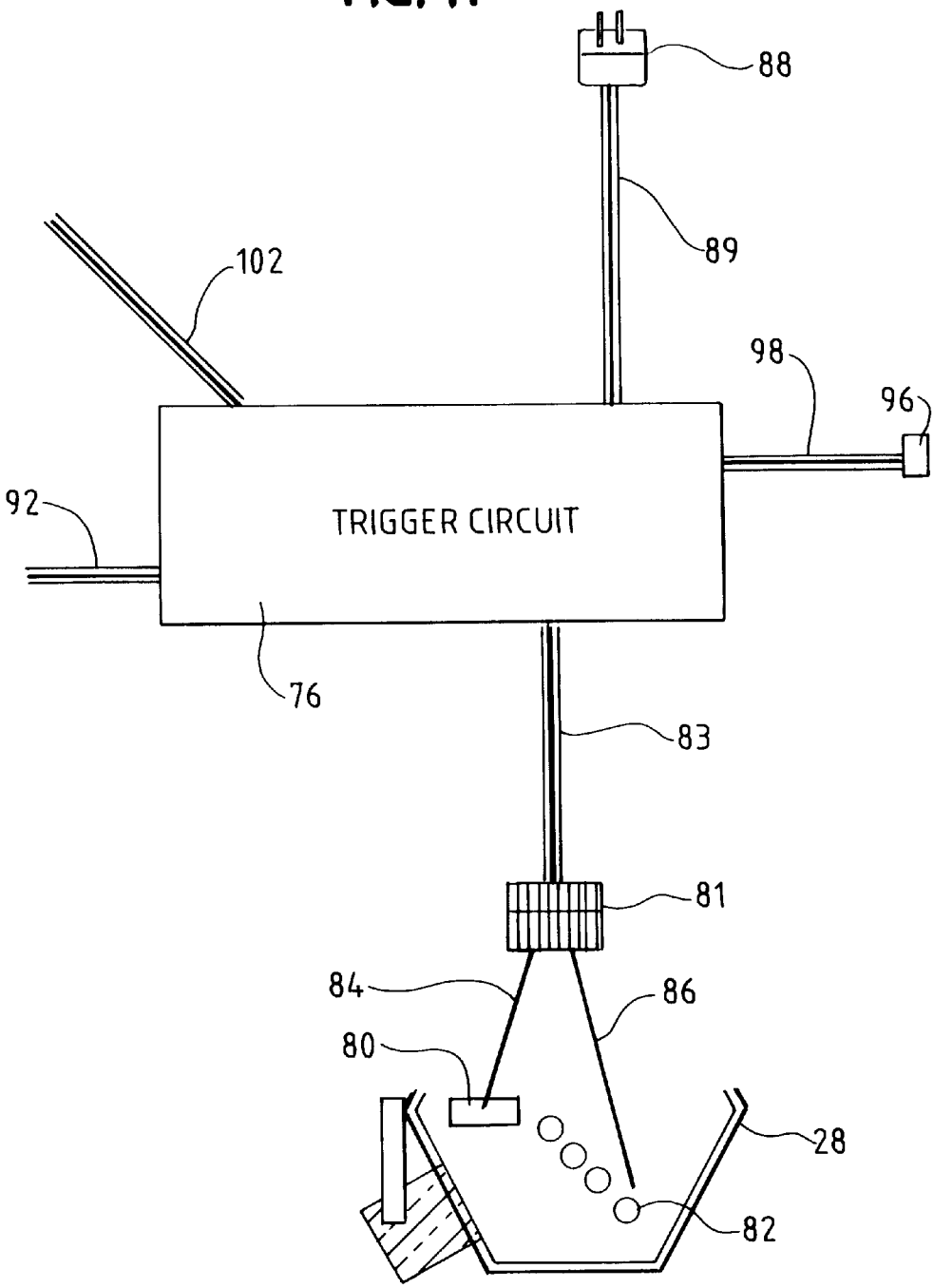
FIG. 11 is a schematic diagram showing the trigger circuit connections for the coin reservoir of the invention.

FIGS. 9–10 illustrate an alternate embodiment of an auxiliary coin reservoir container 104 constructed according to the invention, in which the trap door 106 is controlled by a direct-linkage lever 108 operated by solenoid 110. Upon activation of the solenoid 110, which would be in the same manner as that previously described, solenoid plunger 112 is expelled from the solenoid coil 113 to force spring-loaded arm 114 held by spring 116 to move outwardly of the bottom 118 of container 104. Such movement causes door 106 to move along pivot bar 120 from its first closed position 124 to its open position 125, and thereby release coins (not shown) from container 104 into the hopper 28 in the same manner as previously described.

Figure 19:
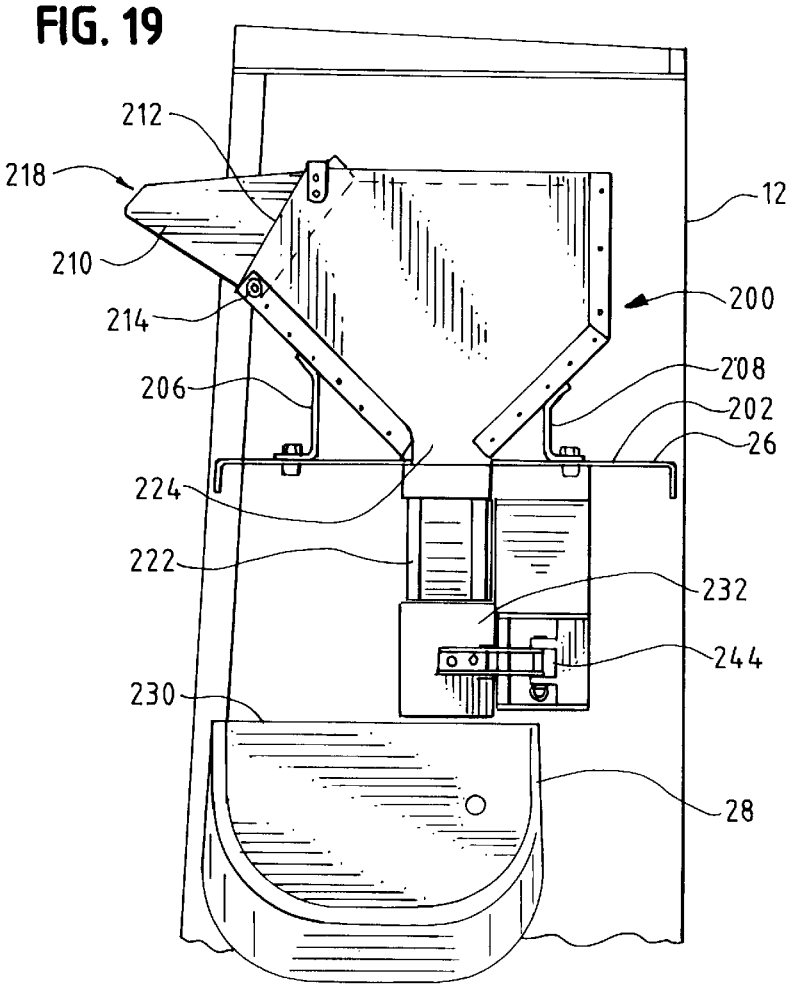
FIG. 19 is a side elevational view of the alternate embodiment shown in FIG. 16, the same illustrated with the coin-fill funnel thereof in open position.
Figure 20:
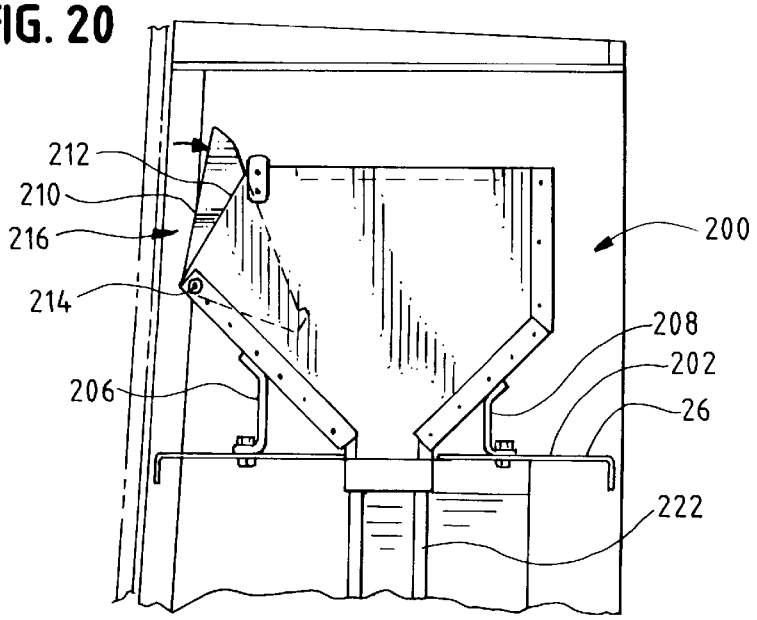
FIG. 20 is a partial view similar to that of FIG. 19, with the coin-fill funnel in closed position.
Figure 21:
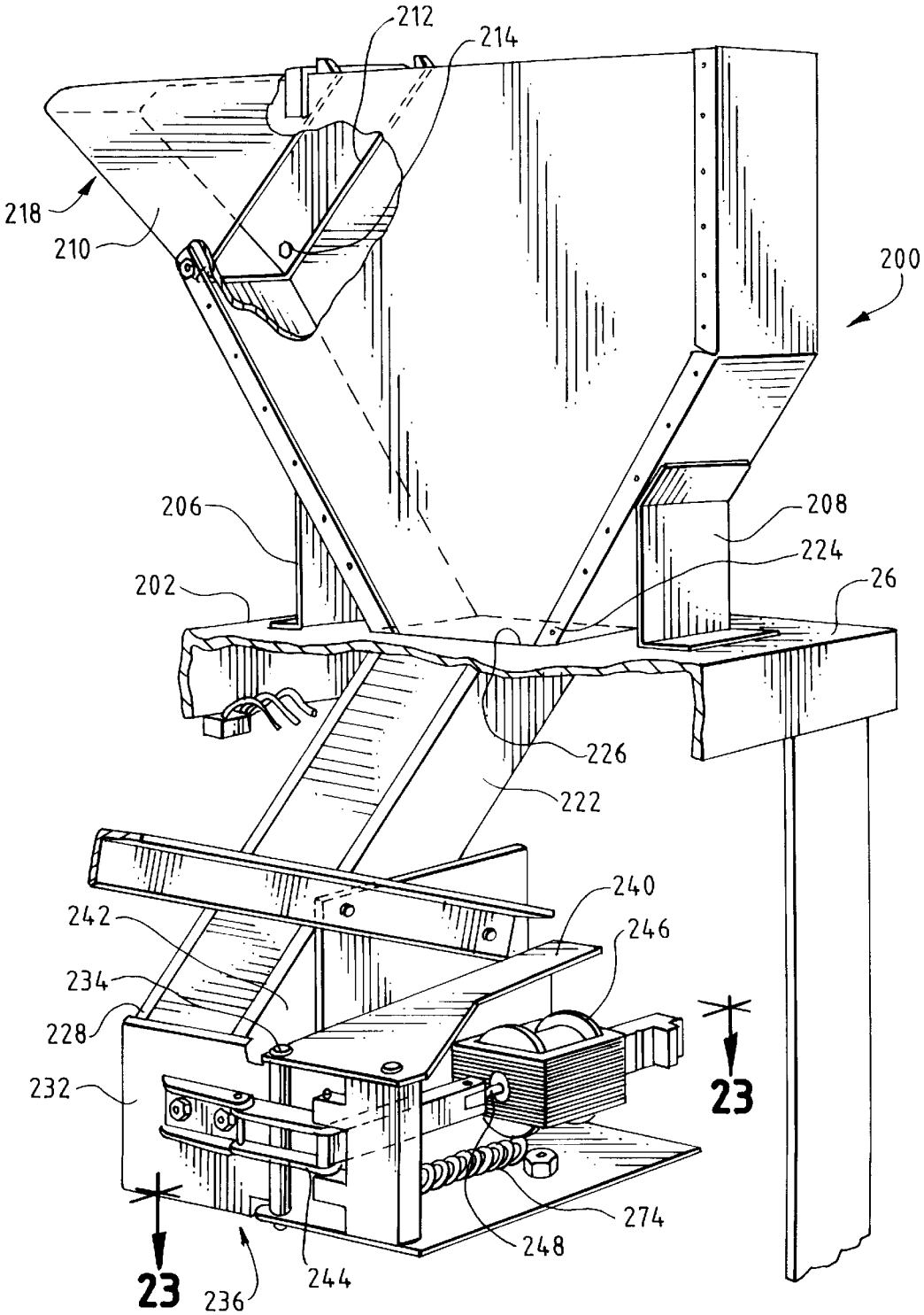
FIG. 21 is a n enlarged fragmentary perspective view of certain component parts of the alternate embodiment shown in FIG. 16.
Figure 22:
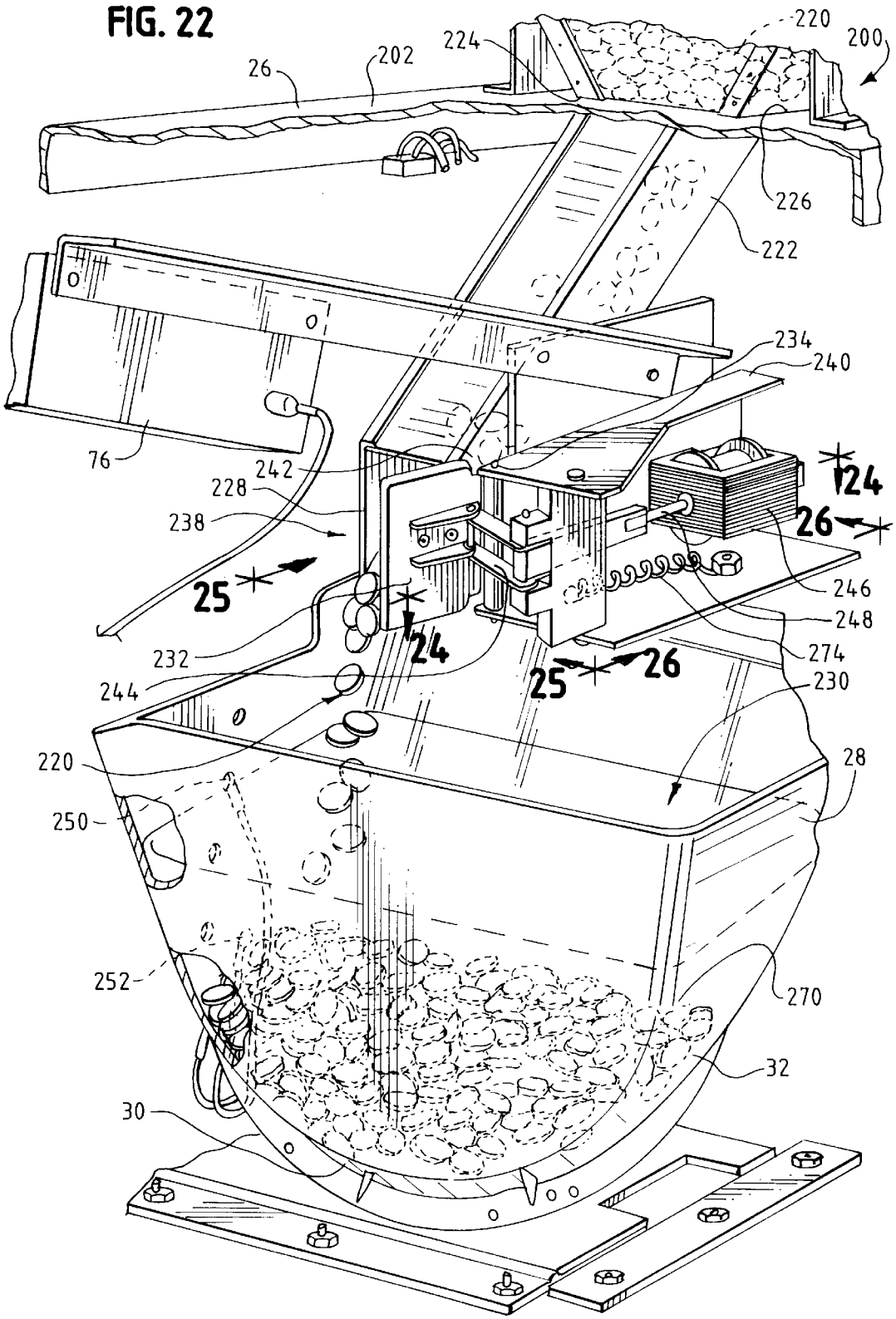
FIG. 22 is a fragmentary perspective view of the embodiment shown in FIG. 16, the same showing the manner in which the coin reservoir empties coins retained therein into the slot machine hopper.
Figure 23:
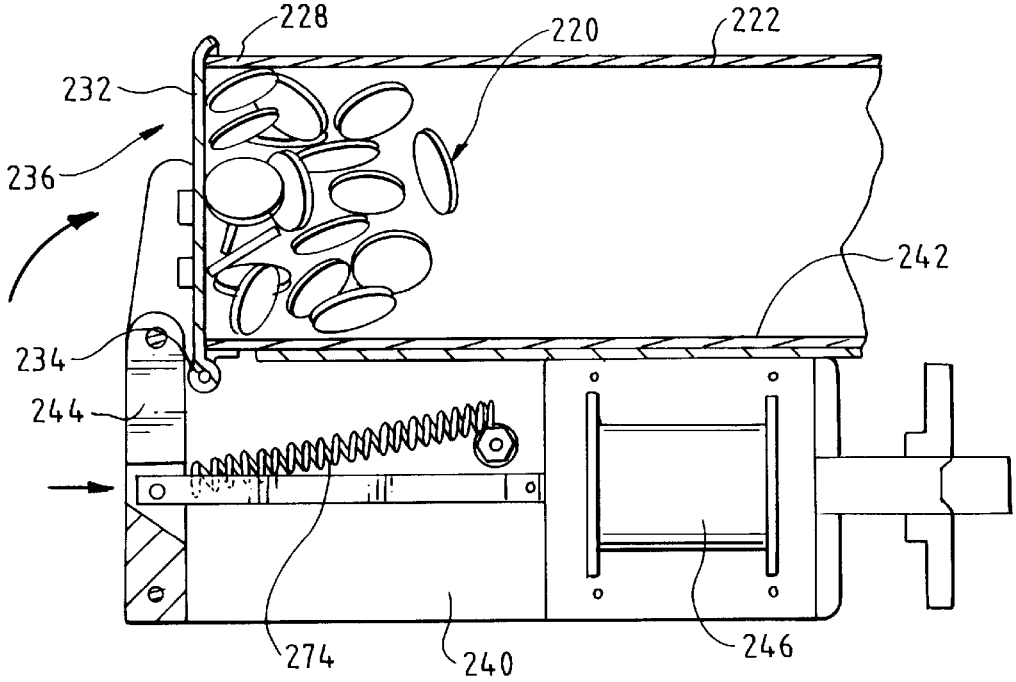
FIG. 23 is a sectional view taken along the line 23—23 of FIG. 21, in the direction indicted generally.
Figure 24:
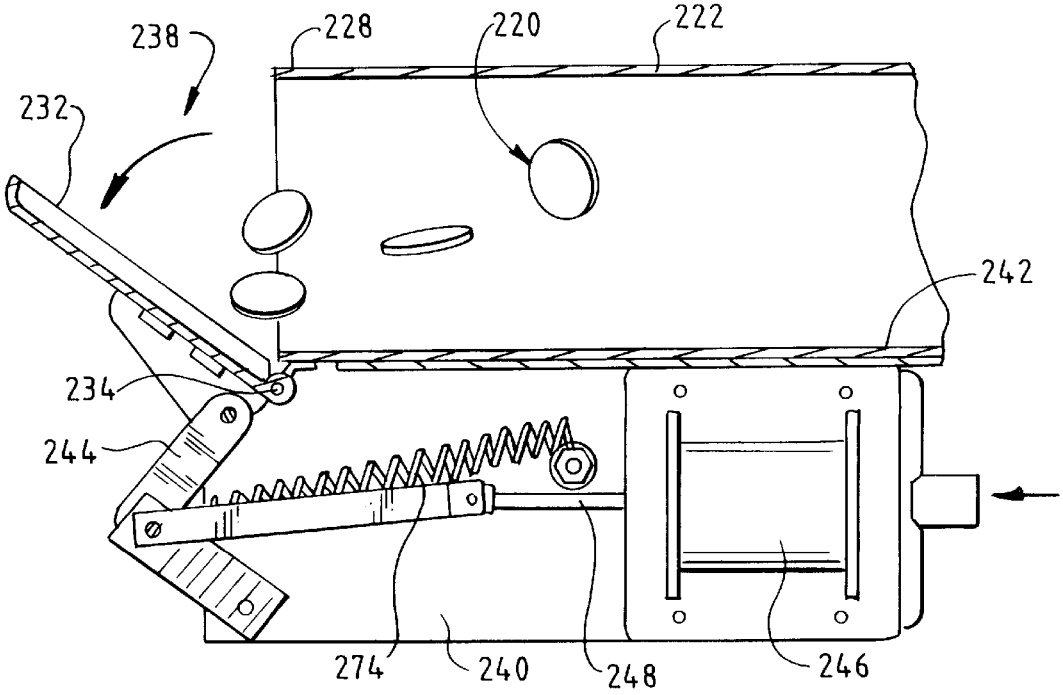
FIG. 24 is a sectional view taken along the line 24—24 of FIG. 21, in the direction indicated generally.
Figure 25:
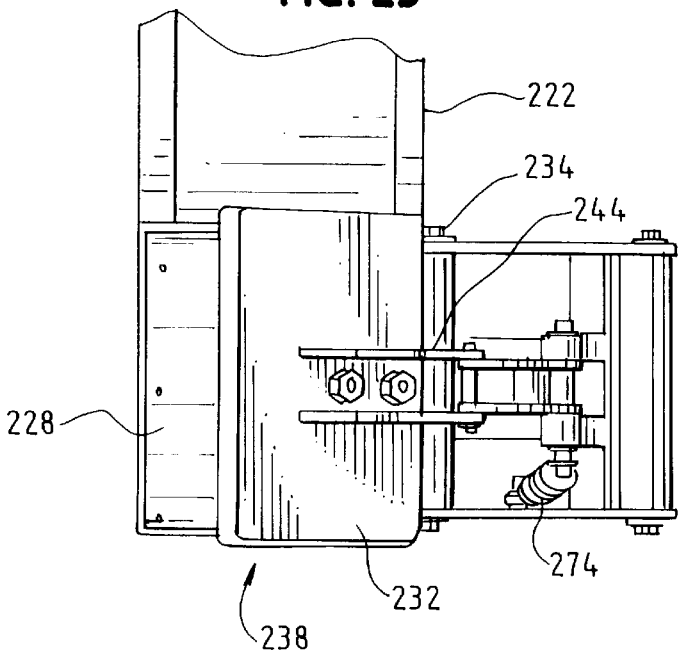
FIG. 25 is a fragmentary view taken along the view line 25—25 of FIG. 22, in the direction indicated generally.
Figure 26:
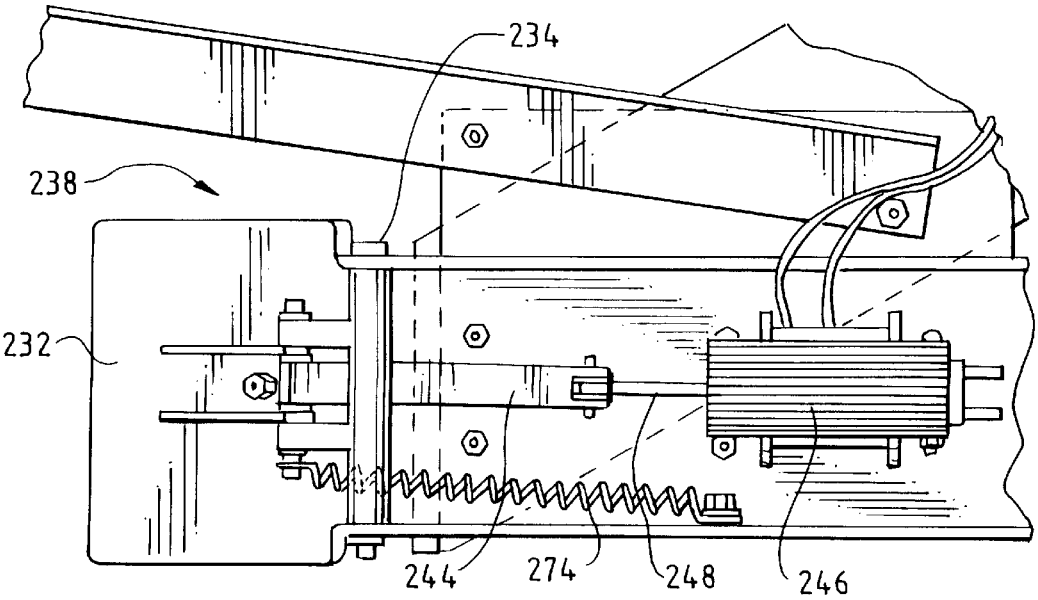
FIG. 26 is a fragmentary view taken along the view line 26—26 of FIG. 22 in the direction indicated generally.

FIGS. 16–29 illustrate a still further embodiment of an auxiliary reservoir container 200 constructed according to the invention. Container 200 is mounted within cabinet 12 in lieu of container 34. Container 200 is positioned upon the top side 202 of reel shelf 26 adjacent to game reels 16. Container 200 includes a top opening 204 and a pair of support brackets 206,208 which rigidify the mount of container 200 upon reel shelf 26. A container fill door 210 is positioned adjacent front lip 212 of container 200 and is pivotal about pivot pin 214 between a first closed position 216 seen in FIG. 20 and a second open position 218 seen in FIG. 19 to facilitate filling of container 200 with coins 220.

A discharge chute 222 is provided at the bottom 224 of container 200 and passes through a passageway 226 formed in reel shelf 26. Chute 222 terminates at end 228 which is positioned adjacent to the open top 230 of coin hopper 28. A release door 232 is installed over end 228 of chute 222 and is pivotal about pivot pin 234 between a first closed position 236 and a second open position 238 in which end 228 opens into hopper 28.

Pivot pin 234 is retained upon bracket 240 mounted to side wall 242 of discharge chute 222. Linkeage 244 is secured between door 232 and solenoid 246 also mounted to bracket 240. Plunger 248 is positioned between solenoid 246 and linkeage 244 to effect opening and closing of door 232 upon activation of solenoid 246. Solenoid 246 is operated by trigger circuit 76 (FIG. 14) to cause door 232 to open and close in the manner to be described.

Container 200 initially is filled with coins 220 when release door 232 is in its closed position 236 by pivoting container fill door 210 to its open position 218. After being so filled, fill door 210 is moved to its closed position 216. In this coin filled condition, the auxiliary reservoir container 200 and automatic hopper fill system of the invention is ready for operation.

Figure 14:
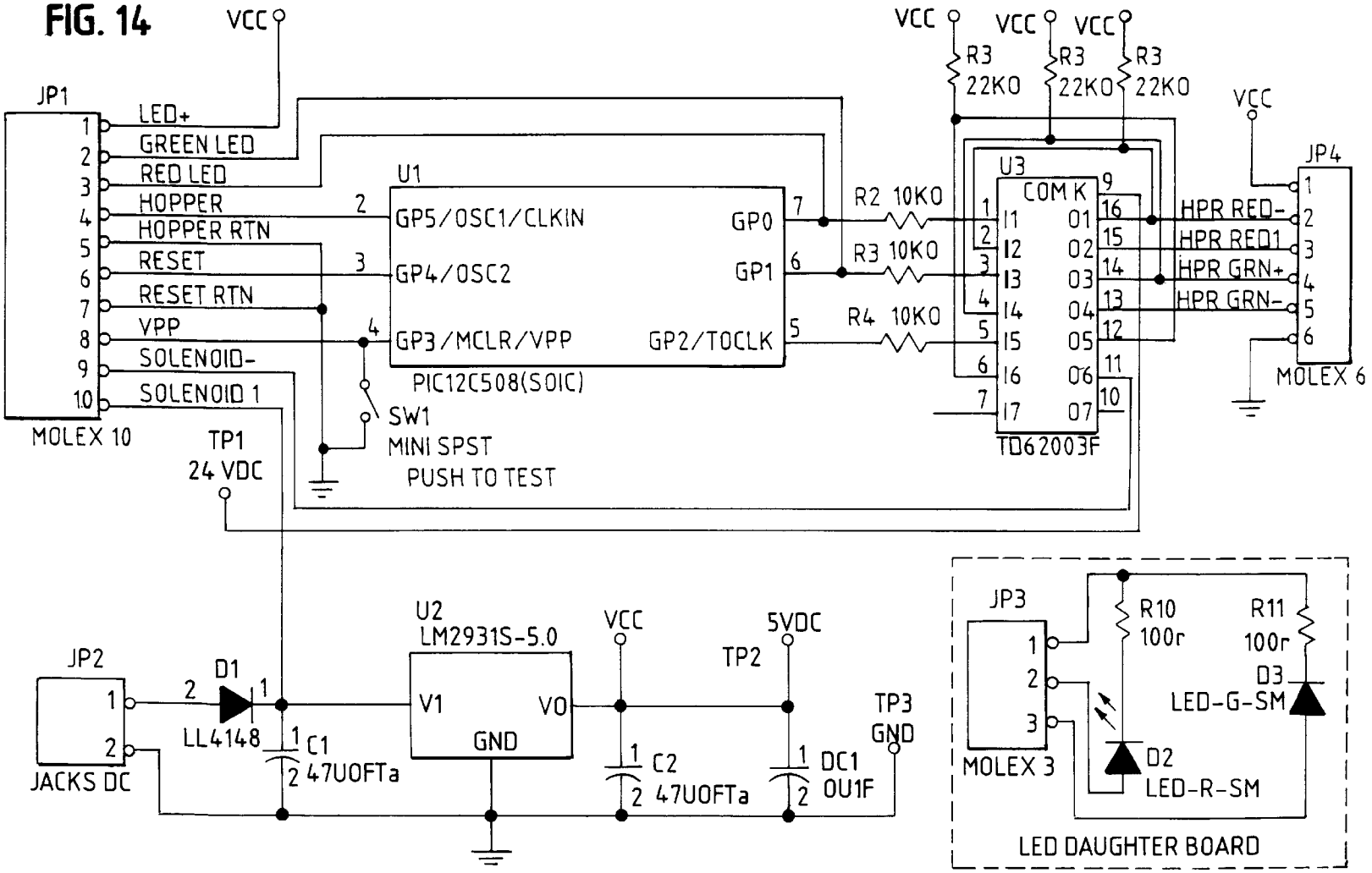
FIG. 14 is a diagram of the hopper fill trigger circuit for the coin reservoir of the invention.
Figure 16:
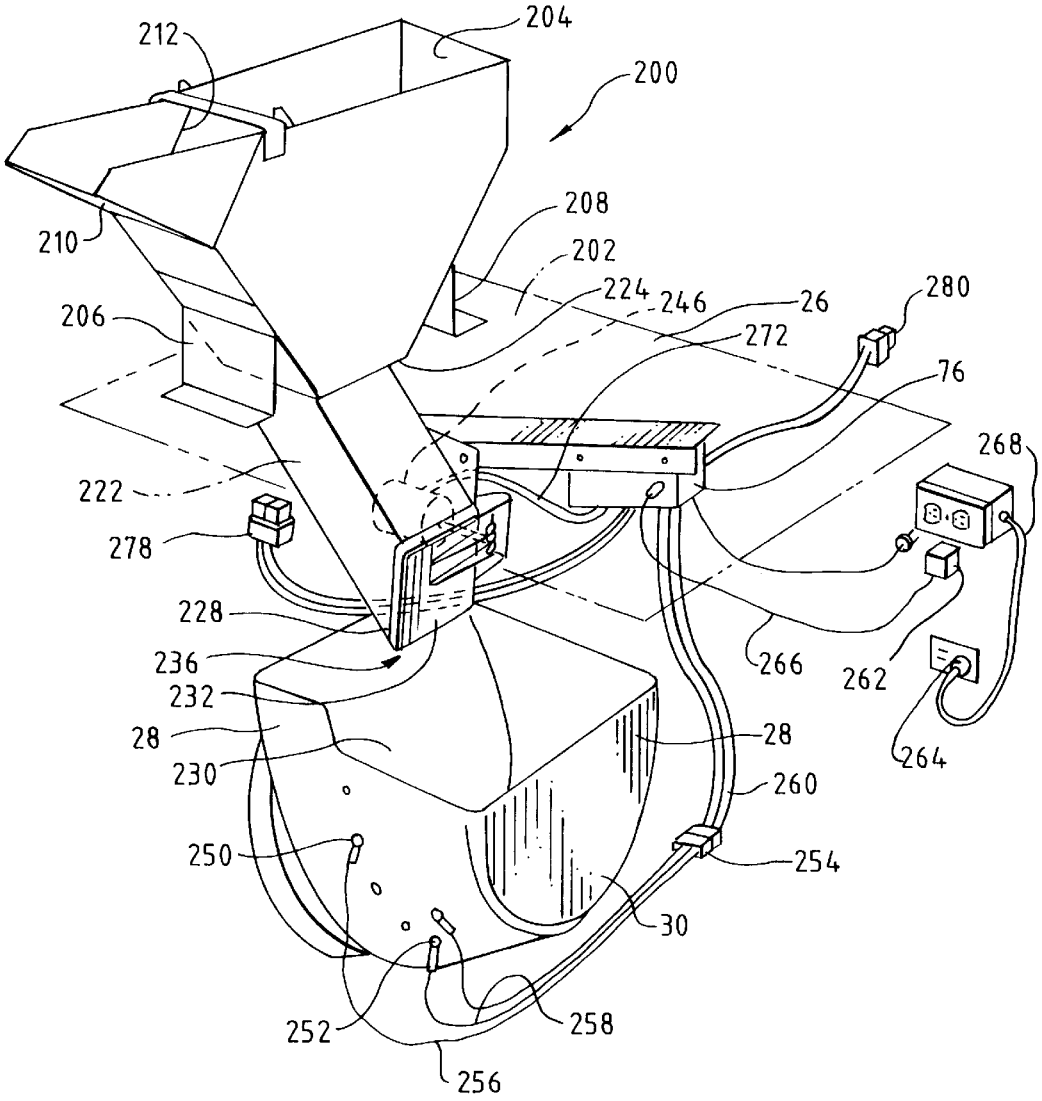
FIG. 16 is a perspective view of certain of the inner components of the slot machine of FIG. 1, the same being shown with another alternate embodiment of the coin reservoir of the invention installed together therewith.
Figure 17:
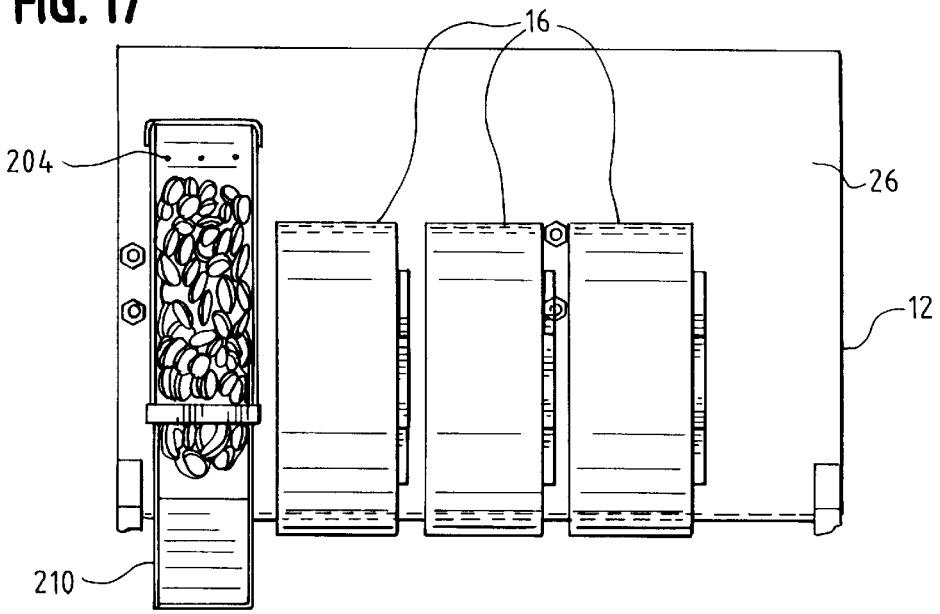
FIG. 17 is a top plan view of the coin reservoir and associated components of the slot machine depicted in FIG. 16.
Figure 18:
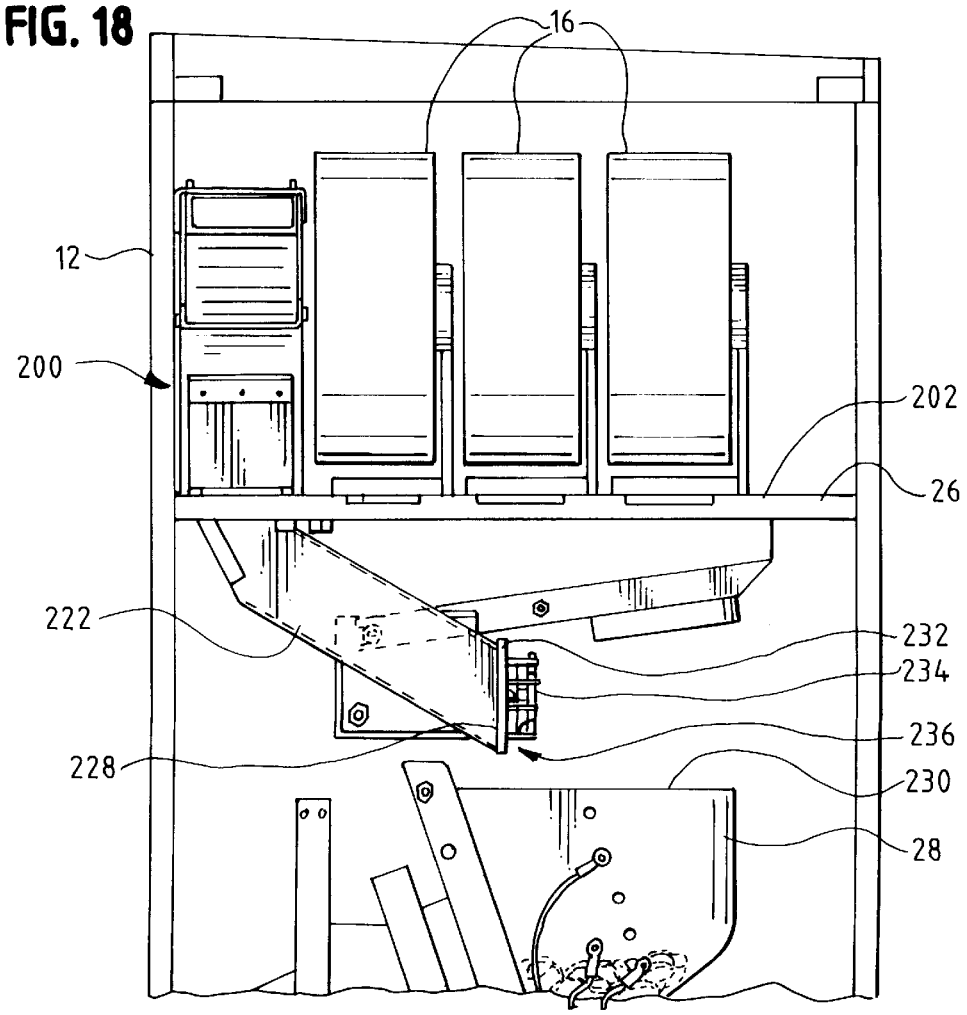
FIG. 18 is a front elevational view of the alternate embodiment shown in FIG. 16.
Figure 27:
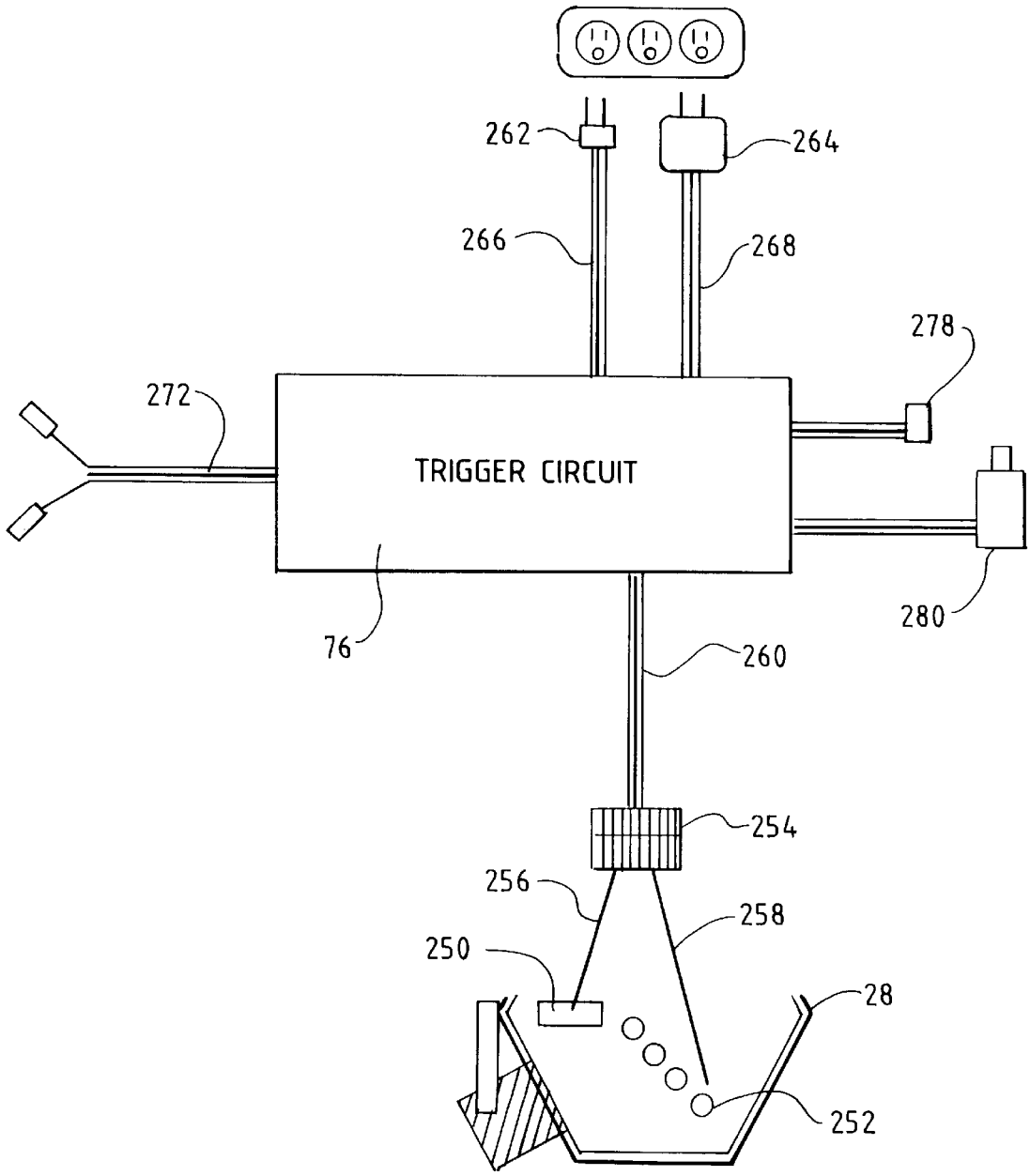
FIG. 27 is a schematic diagram showing the trigger circuit connections for the coin reservoir shown in the alternate embodiment of FIG. 16.
Figure 28:
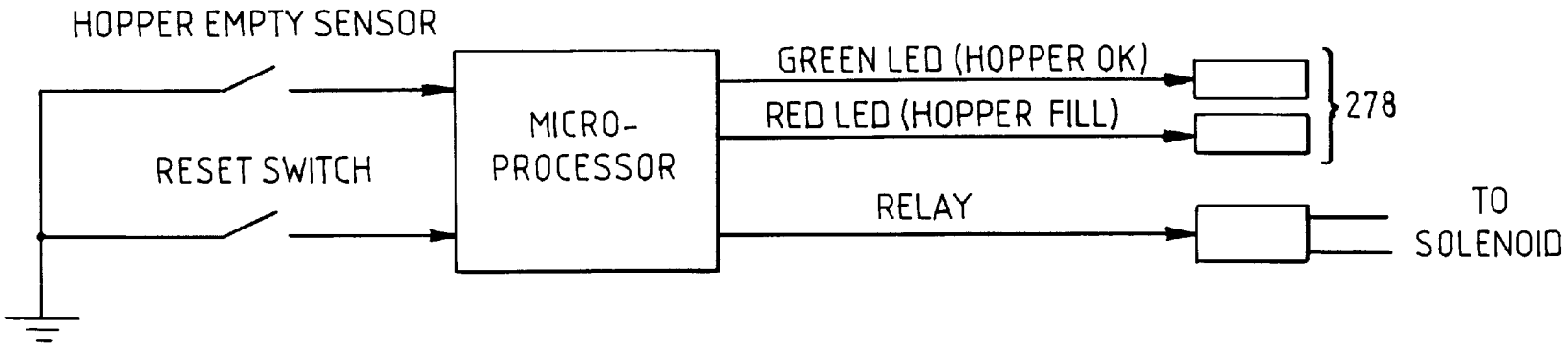
FIG. 28 is a block diagram showing operational features of the coin reservoir shown in the alternate embodiment of FIG. 16.
Figure 29:
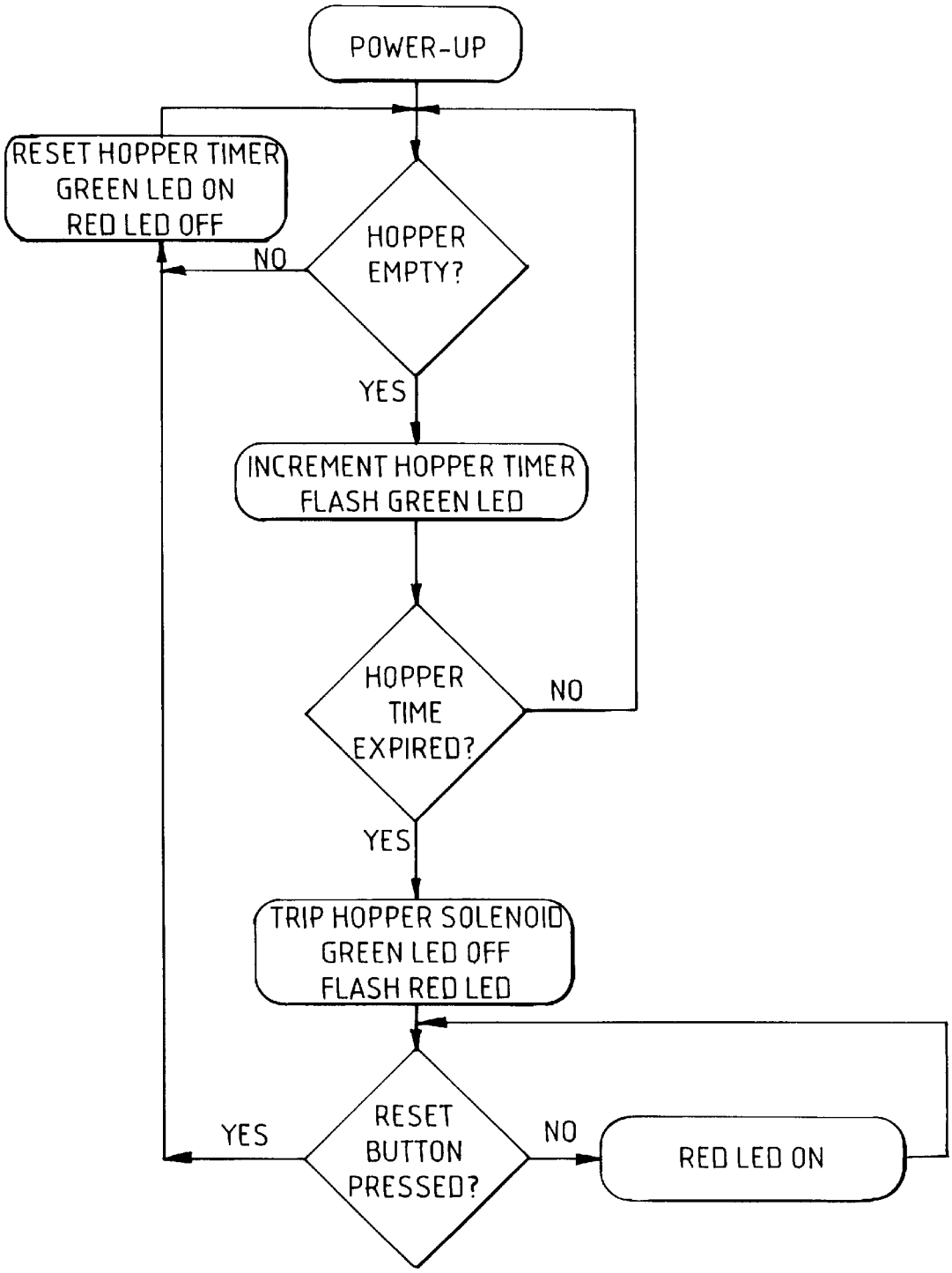
FIG. 29 is a flow chart for operation of the coin reservoir shown in the alternate embodiment of FIG. 16.

Referring to FIGS. 27–29, the sequence of operation is illustrated, which can be enabled by an electrical circuit such as circuit 76 shown and described in FIGS. 14 and 15. Coins 32 supplied to machine 10 along a conduit (not shown) from coin slot 20 to hopper 28 fill the hopper to approximately its complete capacity adjacent to open top 230. The coins in the thus filled condition of hopper 28 establish an electrical connection between separated contacts 250,252 installed within the hopper. An electrical plug 254 joins electrical leads 256,258 between contacts 250,252 along lead 260 to trigger circuit 76 (FIG. 14). The trigger circuit is energized by power supplied through plugs 262,264 along leads 266, 268 in conventional manner.

As the slot machine continues to dispense coins 32 from hopper 28 during play of the machine by a user, the level 270 of such coins will fall below that of contact 250, thus breaking the electrical connection between contacts 250, 252. Trigger circuit 76 thereby causes solenoid 246 to be energized by a signal transmitted through lead 272. Plunger 248 thereby is expelled from the solenoid to act upon linkeage 244 against the force of return spring 274 to move door 232 to open position 238, thereby releasing coins 220 from container 200 down chute 222 into hopper 28 to effect re-filling same. In this manner, operation of the slot machine 20 can continue without being shut down due to an empty condition of hopper 28. Auxiliary reservoir container 200 can be re-filled by the machine owner at a convenient time when the machine is not in use.

Signal light 278 is provided for the same purpose as light 96 described with respect to the embodiment of FIGS. 2–11. A reset switch 280 also is provided for operation of this embodiment to be activated after the container 200 is filled and the system is to be returned to initial operating condition.

Minor variations in the structure and other variations in the arrangement and size of the various parts may occur to those skilled in the art without departing from the spirit or circumventing the scope of the invention as set forth in the appended claims. Importantly, however, all elements of the invention are positioned entirely within the coin dispensing machine 10, and no operational portions thereof (except electrical connection to line supply) are located external of the machine.

What is claimed is:

1. Apparatus for automatically supplying coins to a coin dispensing machine, said machine including a cabinet and a coin-retaining hopper positioned within said cabinet, said hopper having a top open end for receiving coins and a bottom end for dispensing said coins, said apparatus comprising, an auxiliary coin reservoir container mounted entirely within said cabinet proximate the top open end of said hopper, said container including a coin receiving end and a coin dispensing end, said coin dispensing end having an opening positioned adjacent to the top open end of said hopper, a trap door installed upon said container over said coin dispensing end to normally close said opening and prevent coins retained in said container from moving into said hopper, trap door opening means to open said door upon receipt of a signal to do so, hopper status signal means positioned within said hopper to signal a low coin condition of the contents of the hopper, a trigger circuit connected between said hopper status signal means and said trap door opening means to cause said trap door to open when said hopper status signal means signals said low coin condition of the contents of the hopper, and a signal receptor controlled by said trigger circuit to indicate a first signal that said trap door has been opened.

2. Apparatus as claimed in claim 1 in which said machine is a slot machine, said slot machine including a reel shelf, said hopper being positioned below the reel shelf, said auxiliary coin reservoir container being mounted on said reel shelf.

3. Apparatus as claimed in claim 2 in which said auxiliary coin reservoir container is positioned between the reel shelf and the hopper.

4. Apparatus as claimed in claim 3 in which said trap door opening means includes a solenoid mounted to said container, the solenoid being operational to open said trap door upon receipt of a signal from said trigger circuit.

5. Apparatus as claimed in claim 1 in which said signal receptor indicates a second signal that said trap door is closed and said container is filled with a supply of coins.

6. Apparatus as claimed in claim 1 in which said signal receptor is a signal light positioned on the external surface of the cabinet.

7. Apparatus as claimed in claim 2 in which said auxiliary coin reservoir is positioned above said reel shelf, said auxiliary container including a discharge chute terminating at said coin dispensing end, said discharge chute passing through an aperture provided in the reel shelf.

8. Apparatus as claimed in claim 7 in which said trap door opening means includes a solenoid mounted to said container, the solenoid being operational to open said trap door upon receipt of a signal from said trigger circuit.

9. Apparatus as claimed in claim 7 in which said signal receptor indicates a second signal that said trap door is closed and said container is filled with a supply of coins.

10. Apparatus as claimed in claim 7 in which said signal receptor is a signal light positioned on the external surface of the cabinet.

* * * * *